United States Patent [19]

Kawesch

[11] 4,363,145

[45] Dec. 14, 1982

[54] TRACTION MEANS ON SHOWERING SURFACES AND METHOD OF PRODUCING THE SAME

[76] Inventor: Stanley Kawesch, 3206 NW. 88 Ave., Sunrise, Fla. 33321

[21] Appl. No.: 250,180

[22] Filed: Apr. 2, 1981

[51] Int. Cl.[3] ..... B05D 5/00

[52] U.S. Cl. ..... 4/583; 156/631; 156/632; 427/197; 427/198; 427/199; 427/203; 427/204; 427/230; 427/282; 427/287; 427/292; 427/307; 427/388.2; 427/407.1; 427/407.2

[58] Field of Search ..... 427/282, 388.2, 292, 427/198, 287, 197, 307, 407.1, 407.2, 419.2, 419.3, 419.4, 419.6, 389.7, 397.7, 203, 230, 204, 199; 4/613, 612, 583; 156/631, 632

[56] References Cited

U.S. PATENT DOCUMENTS 3,168,411 2/1965 Walsh ..... 427/204
4,129,669 12/1978 Lopez ..... 427/282
4,239,820 12/1980 Salvador ..... 427/282

*Primary Examiner*—John D. Smith
*Assistant Examiner*—Janyce A. Bell
*Attorney, Agent, or Firm*—John W. Huckert

[57] ABSTRACT

The method of providing on location a vitreous enamel bathtub with traction means in a predetermined pattern comprising the steps of:

(a) cleaning the vitreous enamel surface;
(b) securing a stencil having cutouts therein to the bottom of the tub and, in the stencil cutouts;
(c) removing the glaze by etching with acid, scrubbing and sanding;
(d) rewashing the cutouts;
(e) applying an enamel coat;
(f) sprinkling on silica sand;
(g) top coating with enamel;
(h) removing the stencil;
(i) curing the resulting traction means with heat; and
(j) removing any excess sand.

10 Claims, 4 Drawing Figures

TRACTION MEANS ON SHOWERING SURFACES AND METHOD OF PRODUCING THE SAME

BACKGROUND OF THE INVENTION

1. Field of the Invention

The present invention relates to the method of applying traction means to the floors of vitreous enamel, fiberglass and synthetic marble tubs and shower stalls already in place, and to the traction means per se.

2. Description of the Prior Art

Existing prior patents which may be pertinent to this invention are as follows:

| | | | |
|---|---|---|---|
| Gordon | U.S. Pat. No. 2292368 | Aug. 11, 1942 | 4-613 |
| Kerr | U.S. Pat. No. 2294914 | Sept. 8, 1942 | 4-612 |
| Jackson | U.S. Pat. No. 2330365 | Sept. 28, 1943 | 427-203 |
| France et al | U.S. Pat. No. 4205109 | May 27, 1980 | 427-204 |

Permanent anti-slip or traction means for vitreous enamel bathtubs and shower stalls are disclosed in the patents to Gordon and Kerr. These anti-slip areas, however, are provided at the time of the manufacture of the bathing device. Gordon discloses raised traction spots comprised of silica sand sprayed through a stencil and fired at a temperature different from that used on the remainder of the vitreous enamel base. In the patent to Kerr, for a slip-proof shower floor, it is disclosed that silica sand incorporated in an enamel frit may be sprayed in a design pattern, see page 4 col 2, lines 30–43, through a stencil magnetically held to the floor, before firing.

Those anti-slip devices which are commonly applied to tubs and shower stalls already in place, are either rubber mats or small adhesive-backed rubber or vinyl patches which are applied by hand pressure to the bottom surface of the tub. The rubber mats are cumbersome and subject to mildew. The patches are a temporary solution because they deteriorate rapidly. Their adhesive backing, moreover, attracts and retains dirt.

Anti-slip means comprising silica sand laminated between paint layers have been disclosed in both Jackson and France et al.

It is the application of long lasting, low cost, waterproof anti-slip means to the floor surfaces of tubs and shower stalls already in place that is the subject matter of this application.

SUMMARY OF THE INVENTION

Falls in bathtubs and shower stalls are high on the list of frequent household accidents. The problem of inherently slippery when wet vitreous enamel, fiberglass, or synthetic marble bathing facility surfaces, coupled with the fact that most of those facilities presently in use have not been equipped at their manufacture with any traction or anti-slip means, are addressed by the present invention.

The usual remedy has been the use of removable rubber bath mats or patches adhered to the tub surface. The first is cumbersome and unsanitary, the latter is at best a temporary solution in that they rapidly deteriorate in appearance and effectiveness since they do not remain intact but fray at the edges and are difficult to clean and remove. The adhesive used to back these patches attracts and retains dirt. The presently disclosed anti-slip means, are relatively permanent in nature and may be applied in situ, and they retain their good appearance and effectiveness over a long period of use.

They do not have any tacky adhesive to attract dirt and provide a breeding place for bacteria.

In institutions which must provide bathing and showering facilities, such as hospitals, nursing homes, hotels and motels, as well as in private residences, it is highly desirable for the safety and convenience of the user to provide these existing facilities with anti-slip means. It is the prime objective of this invention to provide these existing bathing facilities on location with effective anti-slip means, in a cost efficient manner which will not appreciably interrupt the use of these facilities and which will remain effective over the long term period of use.

These together with other objects and advantages which will become subsequently apparent, reside in the details of construction and operation as more fully hereinafter described and claimed, reference being had to the accompanying drawings forming a part herein wherein like numerals refer to like parts throughout.

DESCRIPTION OF THE PREFERRED EMBODIMENT

Figure 1:
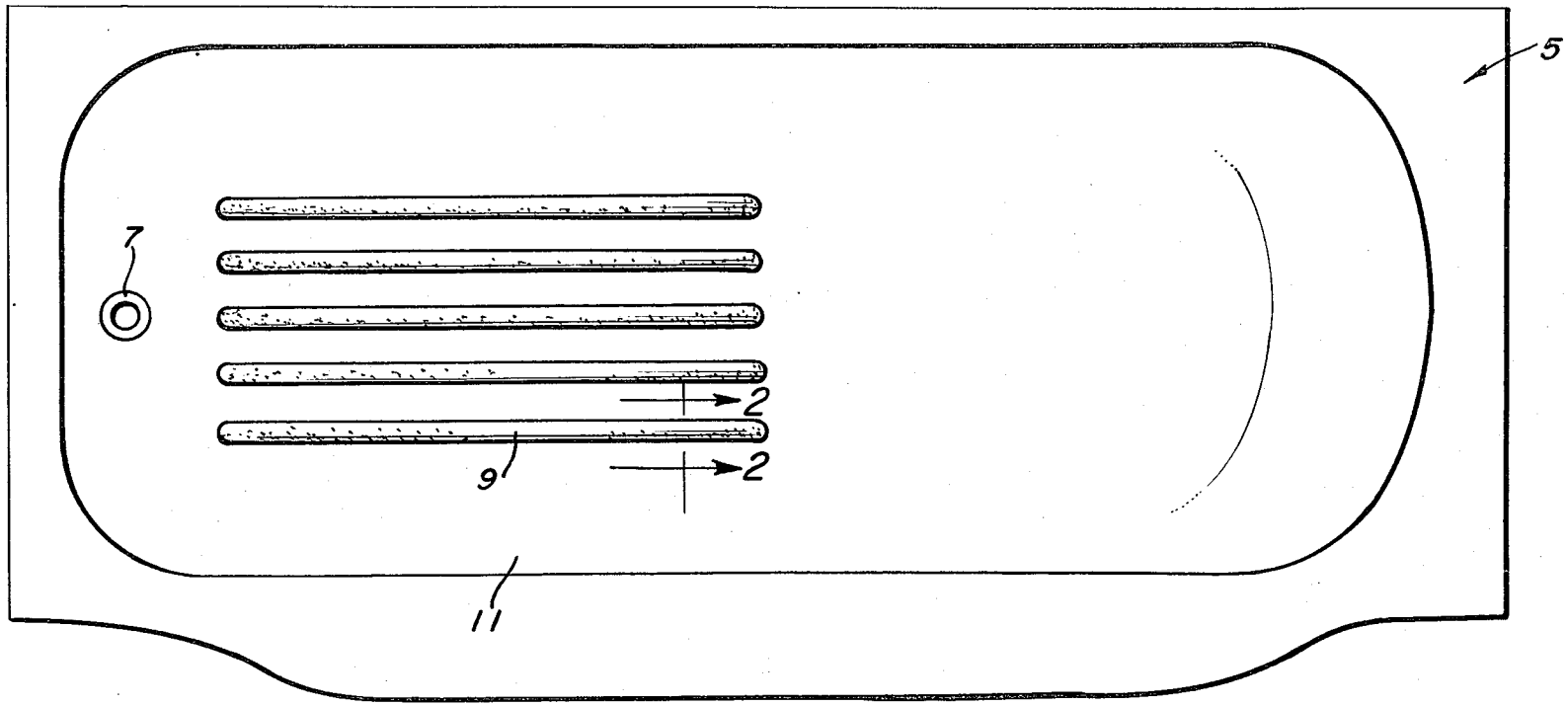
FIG. 1 is a top plan view of the traction means applied to a bathtub.

Referring now to the drawings in detail, and particularly to FIG. 1, reference numeral 5 has been used to designate a bathtub, having a drain 7 traction means 9 and a vitreous enamel surface 11. In the enlarged section view of FIG. 2 the composition of the tub reveals a metal base 21, a layer of clay 33 and a glazed vitreous enamel surface 11 which is formed during the firing process in the original manufacture of the tub.

It should be noted that the placement of the traction means 9 occupies about half the length of the tub, starting about six inches from the tub drain and extending toward the center of the tub. This area provides a safe entering and showering portion, giving the user a secure purchase. The half of the tub area farthest from the drain remains smooth for bathing in the sitting position.

Figure 3:
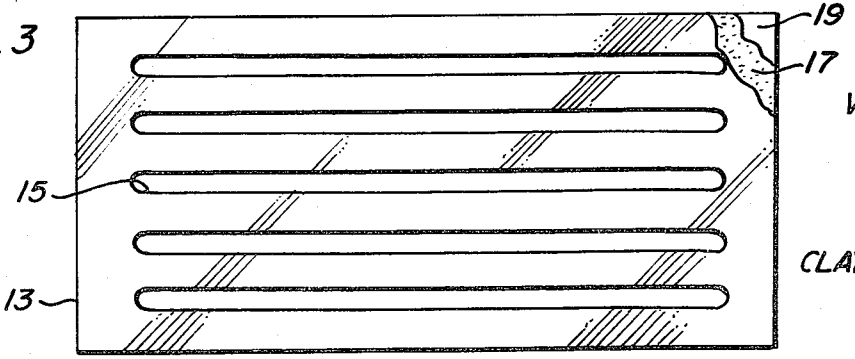
FIG. 3 is a perspective view of the stencil used, with a corner torn away to reveal the composite layers.

FIG. 3 of the drawings shows the stencil 13 which is used in the process of applying the traction means 9 to the tub. The stencil 13 has a series of cutouts 15, the specific configuration of which is optional. A hotel logo, personal signature or other design element may be substituted for the series of strip cutouts 15 shown here for purposes of illustration. The stencil 13 is preferably made of heavy sheet vinyl which is resistant to acid and temperature of 180°. The vinyl is backed with a tacky adhesive 17, and a back cover sheet 19 which protects the adhesive layer, and is easily removable therefrom in the conventional manner.

Figure 2:
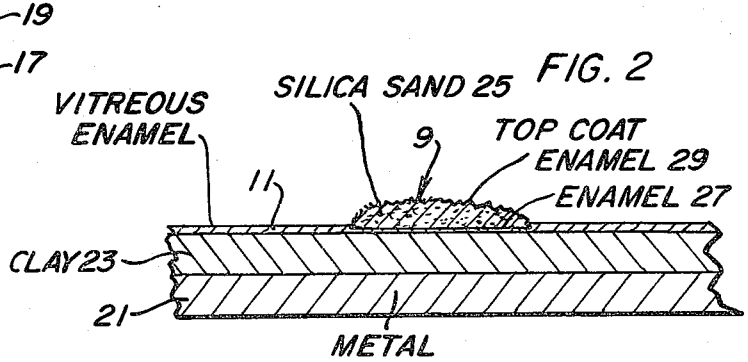
FIG. 2 is an enlarged cross-sectional view taken on line 2—2 of FIG. 1.
Figure 4:
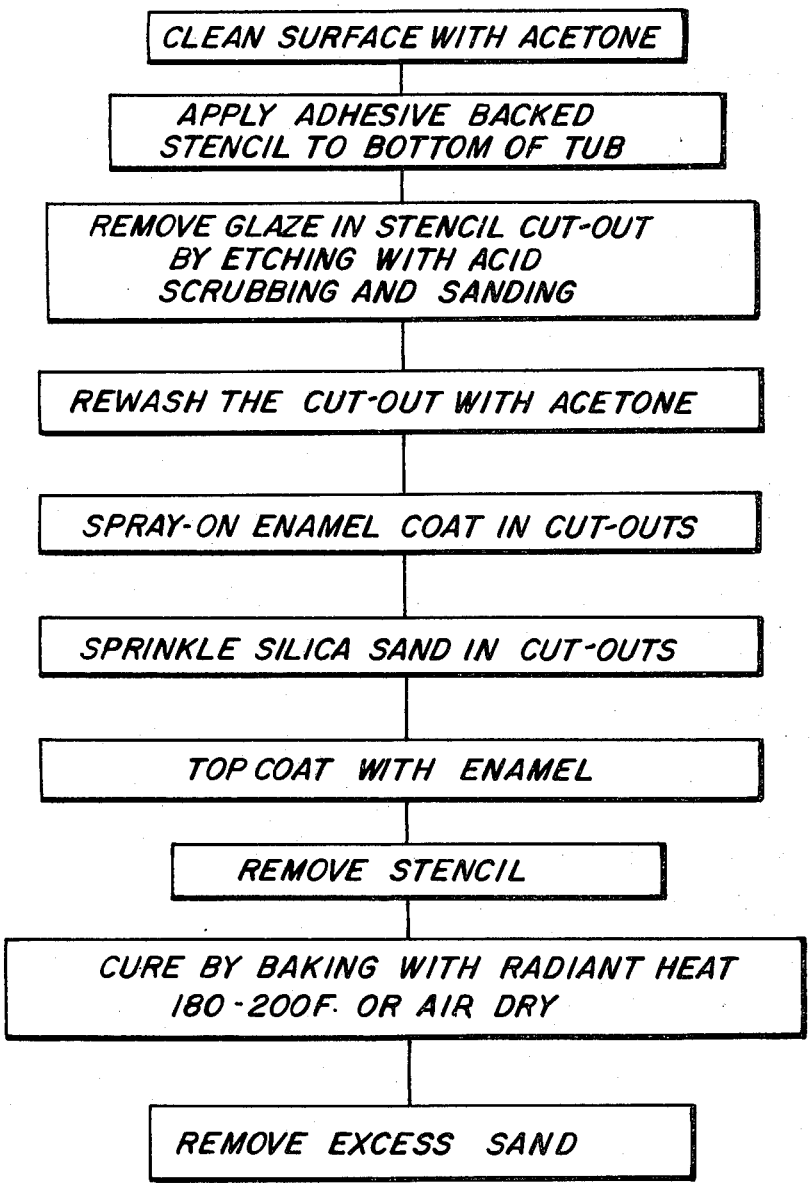
FIG. 4 discloses the steps of applying the traction means to a vitreous enamel surface in situ.

In applying the traction means to the tub as outlined in FIG. 4 of the drawings step (a) involves cleaning the area which is to receive the stencil in order to remove grease and dirt from the surface. This will ensure a good bond between the adhesively backed stencil and the surface avoiding any seepage of chemicals under the stencil. Acetone has been used as the cleaning agent with good result. The cover sheet 19 is peeled away from the stencil 13 and in step (b) the adhesively backed stencil is applied to the bottom of the tub. Care must be taken to see that the stencil is tightly and smoothly adhered to the surface to prevent seepage. Step (c) involves removing the glazed vitreous enamel layer 11 in the cutout areas, using an etching acid, scrubbing, as with a 3M scrubbing pad, and sanding with #100 grit. Hydrofluoric acid is the primary etching agent. It has been found that a solution composed of 1 part 52% hydrofluoric acid to 3 parts of the acid cleaner known as M.A. 50 made by the B.+B. Chemical Co. of Miami, Fla. is effective in removing the glaze 11 and getting down to the powdery clay base 23. The main component of MA50 is hydrofluoric acid. Step (d) of the process comprises rewashing the cutouts with acetone. The surface is now prepared to receive the traction means. In step (e) a layer of enamel paint is sprayed on the exposed clay layer 23 in the cutouts 15, to provide a base or primer. The enamel used is an acrylic urethane enamel paint manufactured by Sherwin-Williams under the name Sunfire 421, or any equivalent acrylic enamel which dries and hardens uniformly throughout by the evaporation of its solvent. In the next step (f) of the process as outlined in FIG. 4 a fine silica sand 25 is sprinkled onto the base enamel 27. The sand may be broadcast, sieved or blown on and in the next step (g) it is topped and sealed with a second coating of the acrylic urethane enamel. It is possible to combine steps (f) and (g) by incorporating the sand particles with the enamel and spraying the mixture directly onto the base coat. The paint from the base coat 27 is drawn through surface tension and capillary action upwardly into the narrow and irregular crevices formed between abutting sand particles 25. The paint from the top layer 29 flows down to cover the top and sides of the sand particles. The enamel paint 27, 29 completely envelops and coats the sand, extending beneath above and between the particles of sand forming a bond as shown in FIG. 2 thus building the traction means 9 so that it is raised slightly above the surrounding vitreous enamel glaze 11. The stencil is then removed [step (h)], and the traction areas 9 are cured. A complete air dry cure might be obtained in two weeks, and a cure of the upper surface sufficient to permit use of the facility may take place in two days. This delay would obviously cause great inconvenience and hardship. Therefore as shown in step (i) radiant heat at 180°–200° F. is used to bake the surface for about 30 to 45 minutes, and will achieve a complete cure of the traction means 9, and this is the method preferred. Excess sand is removed in step (j) by vacuuming or washing with acetone in the traction and surrounding area.

The method of providing vitreous enamel bathtubs and shower stalls with traction means is applicable to fiberglass, plastic and synthetic marble showering surfaces as well. These surfaces are more easily prepared for receiving the primer coat of enamel since the etching step is superfluous.

These surfaces are sufficiently roughened by sanding alone to receive the primer coat of enamel, as well as the subsequent layers of silica sand and enamel topping as outlined in FIG. 4.

The foregoing should be considered as illustrative only of the principle of the invention. Further, since numerous modifications and changes will readily occur to those skilled in the art, it is not desired to limit the invention to the exact construction and process shown and described, and accordingly, all suitable modifications and equivalents may be resorted to, falling within the scope of the invention.

What is claimed is:

1. The method of applying a traction means in a predetermined pattern to a glazed vitreous enamel surface including:

(a) cleaning the glazed vitreous enamel surface with a cleaning agent;

(b) securing a stencil having cutouts therein to the surface;

(c) removing the glaze adjacent the stencil cutouts by etching with acid;

(d) rewashing with the cleaning agent the cutout surfaces from which the glazing has been removed;

(e) applying a coat of acrylic urethane enamel on the cutout surfaces;

(f) sprinkling silica sand on the enamel coat of the cutout surfaces;

(g) top coating the silica sand with acrylic urethane enamel;

(h) removing the stencil;

(i) curing the resulting traction means of the previous steps; and (j) removing any excess sand.

2. The method as defined in claim 1 wherein the cleaning agent used in steps (a) and (d) is acetone.

3. The method as defined in claim 1 wherein the removal of the glaze in step (c) is achieved by etching with a hydrofluoric acid mixture,scrubbing and sanding.

4. The method as defined in claim 1 wherein the enamel coat applied in steps (e) and (g) is high gloss acrylic urethane enamel.

5. The method as defined in claim 1 wherein the curing of step (i) is achieved by baking with radiant heat 180°–200° F. for 30 minutes.

6. A bathtub having a traction means made by the method of claim 1.

7. A bathtub having a traction means made by the method of claim 1, wherein said traction means extends in the bathtub area between the drain and the center of the tub defining an anti-slip area and a smooth sitting area.

8. The method of applying a traction means in a predetermined pattern to a glazed vitreous enamel surface comprising:

(a) cleaning the glazed vitreous enamel surface with acetone;

(b) applying an adhesive backed stencil having cutouts therein to the cleaned surface;

(c) removing the glaze under the stencil cutouts by etching with a hydrofluoric acid mixture, scrubbing and sanding with #100 grit;

(d) rewashing the cutout surfaces with acetone;

(e) applying an acrylic urethane enamel in the cutouts;

(f) sprinking fine silica sand in the cutouts;

(g) top coating the silica sand with acrylic urethane enamel;

(h) curing the resultant traction means by baking with radiant heat at 180°–200° F. for 30 minutes;

(i) removing the stencil; and (j) removing any excess sand and enamel.

9. The method of applying anti-slip means in a predetermined pattern to the floor surface of a showering facility including:

(a) washing the surface;

(b) securing a stencil having cutouts to the surface;

(c) roughening the surface under the stencil cutouts by sanding;

(d) rewashing the roughened surface;

(e) applying a base coat of acrylic urethane enamel in the cutouts;

(f) sprinkling silica and sand on the base coat;

(g) top coating the sand with acrylic urethane enamel;

(h) curing the coated surface;

(i) removing the stencil; and (j) removing any excess enamel and sand.

10. A showering facility floor having anti-slip means applied by the method of claim 9.

* * * * *